US007841309B2

(12) United States Patent
Gründl et al.

(10) Patent No.: US 7,841,309 B2
(45) Date of Patent: Nov. 30, 2010

(54) GAS EXCHANGE VALVE ACTUATOR FOR A VALVE-CONTROLLED INTERNAL COMBUSTION ENGINE

(75) Inventors: Andreas Gründl, Starnberg (DE); Bernhard Hoffmann, Starnberg (DE)

(73) Assignee: Compact Dynamics GmbH, Sternberg (DE)

( * ) Notice: Subject to any disclaimer, the term of this patent is extended or adjusted under 35 U.S.C. 154(b) by 484 days.

(21) Appl. No.: 11/911,632

(22) PCT Filed: Mar. 31, 2006

(86) PCT No.: PCT/EP2006/002967

§ 371 (c)(1),
(2), (4) Date: Apr. 22, 2008

(87) PCT Pub. No.: WO2006/108523

PCT Pub. Date: Oct. 19, 2006

(65) Prior Publication Data

US 2009/0217892 A1 Sep. 3, 2009

(30) Foreign Application Priority Data

Apr. 15, 2005 (DE) ..... 10 2005 017 482

(51) Int. Cl.
*F01L 9/04* (2006.01)

(52) U.S. Cl. ..... 123/90.11; 123/90.16; 251/129.01

(58) Field of Classification Search ..... 123/90.15, 123/90.11, 90.16; 251/129.01, 129.1, 129.15, 251/129.16

See application file for complete search history.

(56) References Cited

U.S. PATENT DOCUMENTS 2,892,140 A 6/1959 Praeg (Continued)

FOREIGN PATENT DOCUMENTS

DE 30 30 910 A1 3/1981

(Continued)

OTHER PUBLICATIONS

U.S. Appl. No. 11/911,635, Unpublished, Gründl, et al.

(Continued)

*Primary Examiner*—Zelalem Eshete
(74) *Attorney, Agent, or Firm*—Thomas R. FitzGerald, Esq.; Hiscock & Barclay, LLP

(57) ABSTRACT

A gas exchange valve actuator for a valve-controlled internal combustion engine is equipped with a rotor, which is to be coupled to a valve member, and a stator, wherein the rotor has at least two stacks, which are arranged at a predetermined distance from one another, of superposed permanently magnetic bars, and the stator is formed, at least partially, from a soft-magnetic material and has at least two pairs of teeth with mutually opposed teeth, of which each pair of teeth receives one of the two stacks between them in each case, while forming an air gap, and wherein the stator has at least two magnetically conductive inner regions which are located between the two stacks and arranged at a predetermined distance from one another in the direction of movement of the rotor and which are at least partially surrounded, in each case, by an essentially hollow-cylindrical coil arrangement, the central longitudinal axis of which is oriented approximately transversely to the direction of movement of said rotor.

18 Claims, 4 Drawing Sheets

U.S. PATENT DOCUMENTS

| | | | | |
|---|---|---|---|---|
| 3,853,102 | A | | 12/1974 | Myers et al. |
| 4,614,170 | A | | 9/1986 | Pischinger et al. |
| 4,638,389 | A | | 1/1987 | Barth |
| 4,829,947 | A | | 5/1989 | Lequesne |
| 4,878,464 | A | | 11/1989 | Richeson, Jr. et al. |
| 4,883,025 | A | | 11/1989 | Richeson, Jr. |
| 4,915,015 | A | | 4/1990 | Richeson et al. |
| 4,917,056 | A | | 4/1990 | Yagi et al. |
| 4,934,348 | A | | 6/1990 | Yagi et al. |
| 4,967,702 | A | | 11/1990 | Richeson et al. |
| 4,991,548 | A | | 2/1991 | Richeson et al. |
| 5,069,422 | A | | 12/1991 | Kawamura |
| 5,129,369 | A | | 7/1992 | Kawamura |
| 5,245,232 | A | | 9/1993 | Nihei et al. |
| 5,406,241 | A | | 4/1995 | Kawamura |
| 5,818,680 | A | | 10/1998 | Schmitz et al. |
| 5,884,591 | A | * | 3/1999 | Giese ..... 123/90.11 |
| 6,039,014 | A | | 3/2000 | Hoppie |
| 6,067,789 | A | | 5/2000 | Dobbeling et al. |
| 7,048,076 | B2 | | 5/2006 | Cecchin et al. |
| 2003/0111029 | A1 | | 6/2003 | Gründl et al. |
| 2005/0076517 | A1 | | 4/2005 | Steffen et al. |

FOREIGN PATENT DOCUMENTS

| | | | |
|---|---|---|---|
| DE | 35 00 530 | A1 | 7/1986 |
| DE | 37 23 979 | A1 | 2/1988 |
| DE | 691 19 703 | T2 | 10/1996 |
| DE | 100 25 371 | A1 | 11/2001 |
| DE | 10 2004 003 220 | A1 | 2/2005 |
| DE | 103 60 713 | A1 | 7/2005 |
| EP | 0 244 878 | B1 | 11/1987 |
| EP | 0 485 231 | A1 | 5/1992 |
| EP | 1 263 122 | A1 | 12/2002 |
| JP | 58-165656 | | 9/1983 |
| JP | 2-246761 | | 10/1990 |
| JP | 03-092518 | A | 4/1991 |
| JP | 8-23669 | | 1/1996 |
| JP | 10-174418 | | 6/1998 |
| JP | 2004-040990 | | 2/2004 |
| WO | WO 90/07635 | | 7/1990 |
| WO | WO 90/07637 | | 7/1990 |
| WO | WO 98/55741 | | 12/1998 |

OTHER PUBLICATIONS

U.S. Appl. No. 11/911,638, Unpublished, Gründl et al.

* cited by examiner

GAS EXCHANGE VALVE ACTUATOR FOR A VALVE-CONTROLLED INTERNAL COMBUSTION ENGINE

CROSS-REFERENCE TO RELATED APPLICATIONS

This is a continuation of International Patent Application No. PCT/EP2006/002967, filed Mar. 31, 2006.

DESCRIPTION

1. Background of the Invention

The present invention relates to a gas exchange valve actuator for a valve-controlled internal combustion engine. In particular, the invention relates to a gas exchange valve in which the opening and closing movement of the valve member is not brought about and controlled by a camshaft. Instead, the valve member is actuated electrically in the case of the gas exchange valve according to the invention.

2. Prior Art

From JP-A-3-92518, a driving apparatus for a valve arrangement in internal combustion engines is known, in which the stator is composed of two approximately semi-cylindrical shells which have teeth which are divided, both in the peripheral direction and in the longitudinal direction of each shell, and which face towards the rotor. The individual teeth in each shell are surrounded, in each case, by a coil whose central longitudinal axis extends in the radial direction. This results in a magnetic flux which is oriented in the radial direction and which flows into the rotor, starting from each individual tooth of the large number of teeth, through the air gap between the stator and the rotor.

A configuration, which is identical in that respect, of the stator, the stator coils and the rotor of a driving apparatus for a valve arrangement in internal combustion engines is described in U.S. Pat. No. 5,129,369. Here too, teeth on the rotor which are subdivided in the radial and tangential directions are surrounded, in each case, by a coil whose central longitudinal axis extends in the radial direction.

EP 0 485 231 A1 also indicates a similar type of design of the stator, the stator coils and the rotor of a driving apparatus for a valve arrangement in internal combustion engines. Here too, teeth on the stator which are subdivided in the radial and tangential directions are surrounded, in each case, by a radially oriented coil.

The manufacture of these arrangements requires a great deal of outlay, since the mounting of the coils around the individual teeth is difficult to carry out. Moreover, the pole pitch that can be achieved in the case of this construction is relatively large.

From DE 103 60713 A1, an electromagnetic linear actuator with a stator having a magnetic unit for generating a magnetic field in an intervening space and with a rotor having a coil is known, which can be moved in the intervening space along the longitudinal axis of the in a manner separated from the stator by means of air gaps, so that a magnetic flux in the air gap extends perpendicularly to the direction of movement of the rotor. The magnetic unit on the stator has permanent magnets which taper conically towards the rotor in the direction of the intervening space. Arranged in the stator in a manner adjoining the permanent magnets are flux concentrator elements which widen conically towards the rotor in the direction of the intervening space.

From WO 98/55741, a valve arrangement for a valve-controlled internal combustion engine is known, with an electric travelling-wave motor as an actuator for a valve member, which actuator has a rotor and a stator which are coupled to a valve member. The stator is composed of metal plates whose face is oriented perpendicularly to the direction of movement of the rotor. The stator has teeth that face towards the rotor, which is constructed as a synchronous or asynchronous rotor, and have, in each case, a closed cylindrical superficies that faces towards said rotor. Stator coil chambers, in which a coil which is oriented parallel to the face of the metal plates is arranged in each case, are formed between two adjacent teeth, in each case, on the rotor.

A valve arrangement for an internal combustion engine, which arrangement is driven by a linear motor, is known from U.S. Pat. No. 6,039,014. In this instance, a stator belonging to the linear motor has a number of coils which are separated from one another by a ferromagnetic housing section in each case. A rotor is composed of a number of sections which consist of a permanently magnetic material and between each of which sections consisting of a ferromagnetic material are arranged.

A gas valve control system having a gas exchange valve which is actuated by an electromagnet arrangement is known from DE 195 18 056 A1. In this case, a signal, which is related to the movement of the armature, is generated in the activating line of the electromagnet arrangement by a special configuration of the pole shank of said electromagnet arrangement. This signal can be evaluated in order to detect any desired positions of the armature without additional sensors. The development of a great deal of noise when the respective end positions are reached, the abrupt braking when said end positions are reached, and the high holding currents required, constitute a major problem when using an electromagnet arrangement for actuating the valve.

The same applies to differential electromagnet arrangements which have been variously proposed and which are deliberately loaded with increasing currents in order to achieve the thrust of about 300-400 N required for the internal combustion engines of motor cars. As a result, the valve, which is loaded by a spring arrangement, first of all performs an oscillating movement before an iron plate arranged on the valve stem rests on the armature of the electromagnet arrangement, so that a very much lower holding current is necessary. In this instance, however, the maximum rotational speed of the internal combustion engine is limited to a considerable extent. The response time on starting up is relatively long since it takes some time, on account of the high power which is necessary, before the valve arrangement has oscillated into its desired position.

Other documents which indicate the technical background to the invention are the following, although this list is not claimed to be exhaustive: DE 33 07 070 A1, DE 35 00 530 A1, EP 244 878 B1, WO 90/07635, U.S. Pat. No. 4,829,947, EP 377 244 B1, EP 347 211 B1, EP 390 519 B1, EP 328 194 B1, EP 377 251 B1, EP 312 216 B1, U.S. Pat. No. 4,967,702, U.S. Pat. No. 3,853,102, DE 10 2004 003220 A1, U.S. Pat. No. 4,829,947, U.S. Pat. No. 4,915,015, WO 90/07637, EP 244 878 B1, EP 328 195 A2.

THE PROBLEM UNDERLYING THE INVENTION

What all the concepts described in the documents mentioned above have in common is that the lift, thrust and dynamics required for gas exchange valves in internal combustion engines are not achieved by means of said concepts with sufficiently compact construction and high reliability for mass-production use in motor vehicle engines. Moreover, known arrangements are very cost-intensive to manufacture and require a lot of space for installation purposes.

SOLUTION ACCORDING TO THE INVENTION

In order to overcome these disadvantages, the invention teaches a gas exchange valve actuator for a valve-controlled internal combustion engine, which actuator is defined by the features in claim 1.

CONSTRUCTION, FURTHER DEVELOPMENTS AND ADVANTAGES OF THE SOLUTION ACCORDING TO THE INVENTION

According to the invention, the gas exchange valve actuator for a valve-controlled internal combustion engine has a rotor, which is to be coupled to a valve member, and a stator, wherein said rotor has at least one stack of superposed permanently magnetic bars. The stator is formed, at least partially, from a soft-magnetic material and has at least one pair of teeth with mutually opposed teeth, of which each pair of teeth receives a stack between them while forming an air gap in each case. The stator has at least two magnetically conductive inner regions which are arranged at a predetermined distance from one another in the direction of movement of the rotor and are at least partially surrounded, in each case, by an essentially hollow-cylindrical coil arrangement, the central longitudinal axis of which is oriented approximately transversely to the direction of movement of the rotor. In its simplest configuration, the rotor has a stack of superposed, permanently magnetic bars. Next to these at the side are arranged, on one side of the rotor, the coil arrangement on the stator and also the at least two magnetically conductive inner regions which are surrounded by the coil arrangements.

In this connection, the invention has identified the fact that, in an arrangement of this kind, the two coil arrangements can be operated in such a way that the magnetic flux through one of the two magnetically conductive inner regions is essentially diametrically opposed, at any point in time, to the magnetic flux through the other magnetically conductive inner region. The overall arrangement consisting of the two coil arrangements with the appertaining stator arrangement thus forms, in combination with the permanently magnetic rotor bars, a self-contained magnetic circuit. In other words it is possible, in the case of the invention, for the magnetic flux induced in one direction by the one coil arrangement to be induced in the other direction at the same time by the other coil arrangement, so that the circuit is closed.

According to the invention, the rotor may have two or more stacks, which are to arranged at a predetermined distance from one another, of permanently magnetic bars, and the magnetically conductive inner regions of the stator may be arranged between the stacks on the rotor.

Another concept which underlies the invention consists in "separating out" that part of the stator which brings about the circulation through the armature, namely the coil region with the stator coil arrangement, spatially from that part which forms the power of the linear motor, namely the tooth region of the stator. By this means it is possible to achieve a considerably higher circulation through the armature, compared to conventional linear motors in which the stator coils are arranged between two teeth, in each case, on the stator. This is due to the fact that, because of the design according to the invention, the coil has considerably fewer spatial limitations and can thus be optimised to minimal (ohmic) losses—and an accompanying maximum magnetic field induction. The arrangement of the stator coil arrangement, whose central longitudinal axis is oriented transversely to the direction of movement of the rotor or, in other words, is essentially in alignment with the central longitudinal axis of two mutually opposed teeth belonging to a pair of teeth, is particularly efficient magnetically, since the magnetic flux induced by a coil oriented in this way flows equally through the pairs of teeth located at both end faces of the coil. An identical force is thereby generated in both stacks of permanently magnetic bars. This avoids oblique running of the rotor without any other special measures.

The invention also makes provision for the hollow-cylindrical coil arrangement to have an essentially rectangular cross-section, viewed along its central longitudinal axis M. A coil, which is essentially rectangular in its outer contour and has a clearance which is likewise essentially rectangular, thereby encloses the relevant magnetically conductive inner regions of the stator.

A pole pitch which is smaller than the size of the stator coil in its longitudinal direction is defined by the dimensions of the permanently magnetic bars in the direction of movement of the rotor, or by the dimensions of a tooth on the stator in the direction of movement of said rotor.

The rotor magnet pole/stator tooth arrangements which give rise to force or movement are likewise concentrated, so that they are not interrupted by stator coil arrangements. This permits a very small pole pitch which, in turn, brings about a high force density. Moreover, with the arrangement according to the invention, partial strokes of the valve member are possible. It might thereby be possible, in the case of an internal combustion engine equipped with the gas is exchange valve actuators according to the invention, to dispense with a conventional throttle valve in the metering system for the fuel/air mixture and its appertaining activating system.

Another essential advantage of the gas exchange valve drive according to the invention consists in the fact that it is practically only the magnetically active components (the permanent magnets) which contribute to the inert mass of the rotor, while all the other parts of the motor (coils, magnetic short circuit, etc.) are allocated to the stator. It is thereby possible to achieve a particularly high ratio of force exerted by the actuator to inert mass. Moreover, the gas exchange valve drive according to the invention is pre-eminently suitable for use in internal combustion engines which run at high speeds. Under these circumstances, it is possible, in particular, for the approach of the valve member to the end positions (open and closed positions of the gas exchange valve) at high speed to take place with high changes in acceleration, so that the valve member impinges at minimal speed at the valve seat, whereas said valve member is otherwise moved at very high speeds. Moreover, the maximum force is available in the end regions of the path of motion. This permits operation of the gas exchange valves which is very low in noise and in wear and is, at same time, very reliable on account of the high stopping forces that can be achieved in the end positions.

Because of the arrangement, which can be very simple in design (a single-phase and hollow-cylindrical arrangement of, for example, rectangular cross-section), of the stator coil arrangements, it is possible to keep the influence of the jarring forces acting upon the coil very low, so that vibrations in the coil, or friction of the latter against the wall of the stator coil chamber, are low. It is thereby possible to manage with minimal material for insulating or lining the stator coil chamber. This also contributes to the compactness and reliability of the arrangement as a whole. Moreover, the simple construction brings about a high power density, even in the case of small gas exchange valves, since the achievable filling factor of the stator coil chamber (coil volume in said stator coil chamber, referred to the overall volume of the latter) is high.

According to the invention, each tooth may have, in the direction of movement is of the rotor, a size which is essentially identical to the size of a permanently magnetic bar in the direction of movement of said rotor, so that, when said rotor is in a predetermined position, at least one pair of teeth on the stator is in alignment with one permanently magnetic bar in each case.

Pairs of teeth on the stator which are adjacent in the direction of movement of the rotor are preferably so dimensioned, relative to the size of the permanently magnetic bars in the direction of movement of said rotor, that at least one other of the permanently magnetic bars is arranged between two permanently magnetic bars which are in alignment with two mutually adjacent pairs of teeth on the stator.

According to the invention, the magnetically conductive inner regions may have at least one of the teeth at their end that faces towards the rotor. In the case of a rotor with two stacks, the magnetically conductive inner regions of the stator which are located between the two stacks have the teeth at their ends that face towards the stacks on the rotor.

Furthermore, the stator may have at least one magnetically conductive outer region which is located outside the stack on the rotor and has at least one of the teeth at its end that faces towards the stack on the rotor.

In the case of a rotor with two stacks, the stator may also have two magnetically conductive outer regions which are located outside the two stacks on the rotor and which have the teeth at their ends that face towards the stacks.

According to the invention, the externally located region of the stator is of essentially comb-shaped design in cross-section, at least in a partial section. In this case, the teeth on the comb form the outer teeth of the pairs of teeth.

Adjacent bars in a stack have, according to the invention, an alternating magnetic orientation, the longitudinal axis of this orientation being essentially in alignment with the central longitudinal axis of two mutually opposed teeth belonging to a pair of teeth.

According to the invention, the central longitudinal axis of the coil arrangement may be oriented approximately transversely to the direction of movement of the rotor. It is likewise possible, according to the invention, for the central longitudinal axis of the coil arrangement to be approximately in alignment with the central longitudinal axis of two mutually opposed teeth belonging to a pair of teeth, or to be oriented essentially parallel to it, at least in certain sections. This permits an angled design of the inner regions of the stator, for example in order to obtain suitable space for mounting the coil arrangements.

In conformity with the invention, the predetermined distance between the two magnetically conductive inner regions may be so dimensioned that it is essentially identical to the size of an even number of permanently magnetic bars in the two stacks in the direction of movement of the rotor.

Two adjacent permanently magnetic bars, in each case, in the two stacks on the rotor may, according to the invention, be connected to one another at a predetermined distance by magnetically inactive spacers. These spacers may contain a light, magnetically inactive material (aluminium, titanium, plastic—including plastic with glass fibre or carbon fibre inclusions—or the like). As a result, the inert mass of the rotor is low, but its stability high.

Because of the dimensions of the permanently magnetic bars in the direction of movement of the rotor and the dimensions of the teeth on the stator in the direction of movement of said rotor, it is possible, according to the invention, to define a pole pitch which is smaller than the size of the stator coil arrangement in the direction of movement of said rotor.

The outer region(s) of the stator may, according to the invention, have at least one stator coil in addition to, or instead of, the inner regions of the stator.

The size of the coil arrangement on the stator in the direction of movement of the rotor may, according to the invention, be larger than the distance between two adjacent pairs of teeth on the stator.

On account of the path of the magnetic flux through the stator, which path is is almost exclusively two-dimensional, said stator (the inner and/or outer magnetically conductive region) is preferably composed of parts made of electric sheets. However, it is also possible to manufacture it, at least partly, as a soft-magnetic shaped body, preferably made of pressed and/or sintered metal powder.

According to the invention, the outer regions of the stator form, at least partially, a magnetic short-circuiting body.

Finally, the invention relates to a valve-controlled internal combustion engine (spark-ignition or diesel engine) having at least one combustion cylinder which has at least one gas exchange valve actuator having the above features.

Because of the high power density of the arrangement according to the invention, the transverse dimensions of the gas exchange valve having the necessary power data can be kept very small. This permits its use in compact motor car engines.

So-called "paving-breakers" or "electric chisels" represent a further possible application for the linear actuator according to the invention. In these cases, the previous pneumatic or electromagnetic drives are replaced by the linear actuator according to the invention for the purpose of driving the tool. Basically, still other possible applications for the linear actuator described above can also be conceived of, all of which are covered by the present invention.

Other features, properties, advantages and possible variations will be explained with the aid of the description that follows, in which reference is made to the appended drawings.

DETAILED DESCRIPTION OF CURRENT PREFERRED FORMS OF EMBODIMENT

Figure 1:
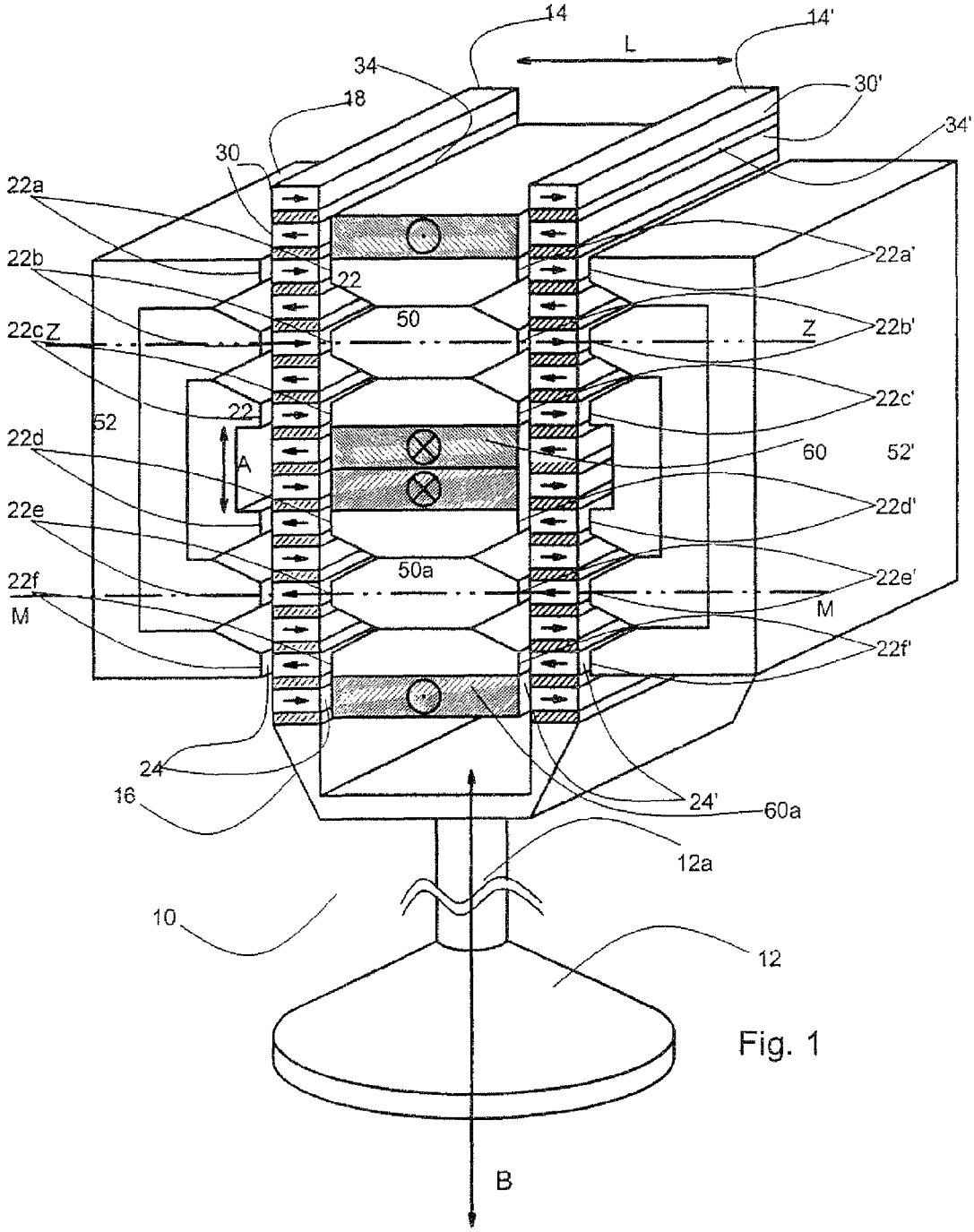
FIG. 1 illustrates, diagrammatically and in a longitudinal section in perspective, one form of embodiment of a gas exchange valve actuator according to the invention.

FIG. 1 illustrates a first form of embodiment of an electric linear motor 10 which serves, in the valve arrangement according to the invention, as an actuator for a valve member 12 belonging to a gas exchange valve, whose appertaining valve seat is not illustrated. The linear motor 10 has a rotor 16, which is coupled to the valve member 12 via a rod 12*a*, and a stator 18. Those skilled in the art understand that the term "rotor" is used broadly to identify a moving element even though the motion is translational and or rotational. In the following description the rotor 16 translates and reciprocates along its axis. Said rod 12*a* is provided with an apparatus, of which nothing further is illustrated but which permits rotation of the valve member 12 about its central longitudinal axis and makes it possible to compensate for dimensional tolerances.

The rotor 16 has two parallel stacks 14, 14' which are arranged at a distance L from one another and consist of a large number of superposed permanently magnetic bars 30, 30' having an essentially parallelepipedal design.

The stator 18 is in the form of a soft-magnetic shaped body made of sintered ferrous metal powder or of stratified iron plates. The stator 18 has a number of pairs of teeth 22*a*, 22*a*'; 22*b*, 22*b*'; 22*c*, 22*c*'; 22*d*, 22*d*'; 22*e*, 22*e*'; 22*f*, 22*f*' having mutually opposed teeth 22. One of the two stacks 14, 14' is received, in each case, between the teeth 22 belonging to a pair of teeth, while forming an air gap 24 or 24' respectively.

Between the two stacks 14, 14' on the rotor 16, the stator 18 has magnetically conductive inner regions 50, 50*a* which are arranged at a predetermined distance A from one another in the direction of movement B of the rotor 16. Each of the two inner regions 50, 50*a* of the rotor is surrounded by an essentially hollow-cylindrical coil arrangement 60, 60*a* in each case. The central longitudinal axis M of the respective coil arrangements 60, 60*a* extends approximately transversely to the direction of movement B of the rotor 16. The coil arrangement 60, 60*a* is embodied as a coil of copper tape in order to achieve the highest possible filling factor.

The two coil arrangements 60, 60*a* are to be loaded with current in such a way that they generate a magnetic field in the opposite direction in each case. In FIG. 1, the upper coil arrangement 60 generates, when the rotor 16 is in the position shown, a magnetic field which is essentially oriented along the central longitudinal axis of the coil arrangement 60 from left to right, while the lower coil arrangement 60*a* generates, when the rotor 16 is in the position shown, a magnetic field which is essentially oriented along the central longitudinal axis of the coil arrangement 60 from right to left. This changes in order to drive the rotor 16 (up or down) along the direction of movement B.

Figure 2:
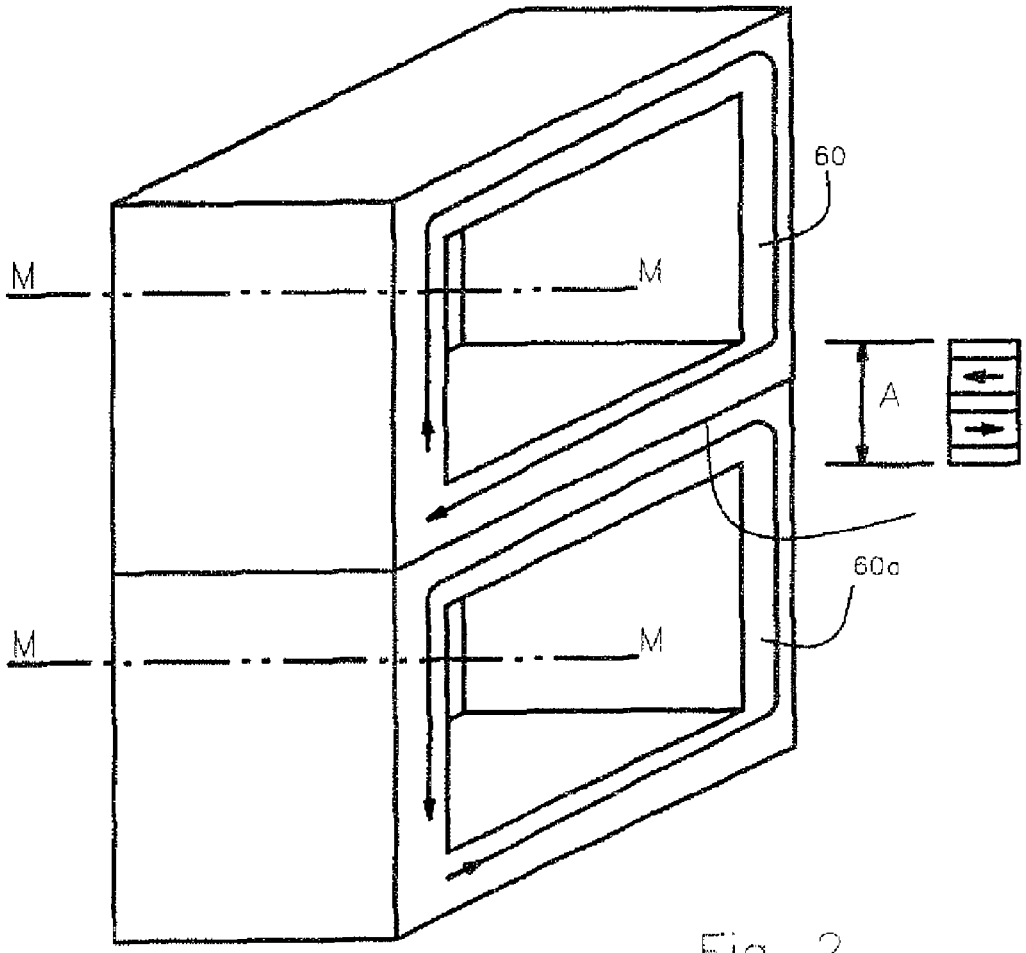
FIG. 2 illustrates, diagrammatically and in a plan view in perspective, one form of embodiment of a coil arrangement belonging to the gas exchange valve actuator according to the invention.
Figure 4:
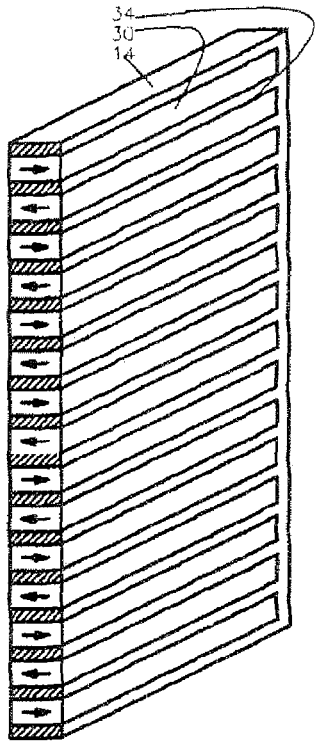
FIG. 4 illustrates, diagrammatically and in a plan view in perspective, one form of embodiment of a stack of magnetic bars belonging to the gas exchange valve according to the invention.

Since each coil arrangement 60, 60*a* completely surrounds, over its entire extension, the relevant region of the two inner regions 50, 50*a* of the stator 18, it can be filled up with the maximum winding space. As is illustrated in FIGS. 1 and 2 by means of suitable arrows—or rather points and ends of arrows—the two coil arrangements 60, 60*a* are to be supplied with current in such a way that they conduct current in the same direction, in each case, in the central section 64 in which they abut against one another (see FIG. 2).

In the arrangement shown, the rotor 16 is formed from two stacks 14, 14' which are directed in a parallel manner and whose magnetic bars are formed from permanently magnetic material (for example samarium-cobalt). The individual magnetic bars 30 are superposed in a flush manner, their magnetic orientation being directed in an alternating manner (from the inner region of the stator 18 outwards, and vice versa). Moreover, the dimensions of the magnetic bars 30 are so designed that, when the rotor 16 is in a predetermined position, one of the magnetic bars 30 is in alignment between two teeth 22 belonging to a pair of teeth on the stator 18. Adjacent bars 30, 30' in a stack 14, 14' have an alternating N->S, S<-N magnetic orientation. When the rotor 16 is in certain positions, each of these bars is thereby in alignment with teeth 22 on the stator 18. In these positions of alignment, the central longitudinal axis Z of two mutually opposed teeth 22 also essentially coincides with the magnetic orientation of the particular bar which is in alignment. As can be seen, the central longitudinal axis N of the coil arrangement 60 is also oriented approximately transversely to the direction of movement of the rotor 16 and is approximately in alignment with the central longitudinal axis of two mutually opposed teeth belonging to a pair of teeth.

In order to reduce the inert mass of the rotor 16, magnetically inactive spacers 34, 34' made of plastic, for example carbon fibre-reinforced plastic, which are likewise parallelepipedal, are inserted between two adjacent magnetic bars 30 in a stack 14, 14'. The mutually adjacent permanently magnetic bars 30 and the magnetically inactive spacers 34, 34' are fixedly connected to one another. In other words, the movable part of the actuator (the rotor) contains no parts (such as flux-conducting pieces for example) which conduct magnetic flux, but only permanent magnets which are always arranged in the optimum manner in the magnetic field. This arrangement also has the advantage of saving weight. If parallelepipedal bars made of permanently magnetic material are not available with sufficient magnetic field strength, it is also possible, according to the invention, to assemble the bars from permanent-magnet segments in such a way that a magnetic field which is directed (from the inside outwards or vice versa) is produced transversely to the direction of movement of the rotor 16.

The stator 18 also has two magnetically conductive outer regions 52, 52' which are located outside the two stacks 14, 14' on the rotor 16 and which are preferably manufactured as bundles of iron plates on account of the guidance of magnetic flux, which guidance is almost exclusively two-dimensional. However, it is likewise possible to shape these in the form of soft-magnetic shaped bodies made of sintered ferrous metal powder. These externally located regions 52, 52' of the stator 18 are of essentially comb-shaped design in cross-section and have, at their ends that face towards the stacks 14, 14' on the rotor 16, teeth 22 which correspond in a mirror-inverted manner in their shape to the teeth of the internally located regions 50, 50*a* of the stator 18.

Located between the magnetically conductive inner regions 50, 50*a* is a predetermined distance A which is so dimensioned that it is essentially identical to the size of an even number (two in the form of embodiment shown) of permanently magnetic bars 30, 30' in the two stacks 14, 14' (with appertaining spacers) in the direction of movement B of the rotor 16. The length of the externally located regions 52, 52' of the stator 18, which are of comb-shaped design in cross-section, is so dimensioned that corresponding teeth 22 at both ends, which face towards the magnetic bars on the rotor 16, lie opposite a magnetic bar of different orientation in each case. In other words, when the rotor is in a certain position, the teeth 22 belonging to the pair of teeth 22*d* are in alignment with an outwardly oriented magnetic bar, while the teeth 22 belonging to the corresponding pair of teeth 22*c* are in alignment with an inwardly oriented magnetic bar. The same applies, in a corresponding manner, to the teeth 22 belonging to the pair of teeth 22*e*, which correspond with the teeth 22 belonging to the pair of teeth 22*b*, and also to the teeth 22 belonging to the pair of teeth 22*f*, which correspond with the teeth belonging to the pair of teeth 22*a*. The outer regions 52 of the stator 18 thereby form a magnetic short-circuiting body. FIG. 1 illustrates the comb-shaped regions of the outer regions 52, 52' of the stator 18 in the form of three individual C-shaped yokes which are fitted into one another. However, it is also possible to design the two outer regions 52, 52' of the stator 18 as, in each case, a bundle of one-piece, soft-magnetic, comb-shaped metal plates which are provided with the teeth in each case. An essential advantage of the arrangement, according to the invention, of the outer region(s) of the stator 18 lies in the fact that almost no stray magnetic flux is given off into the environment. This is important, particularly in the case of arrangements in which a plurality of linear actuators of this type, the activation of which differs from one to another, is positioned in a tight space. This applies, for example, to a multi-valve cylinder in an internal combustion engine.

Figure 3:
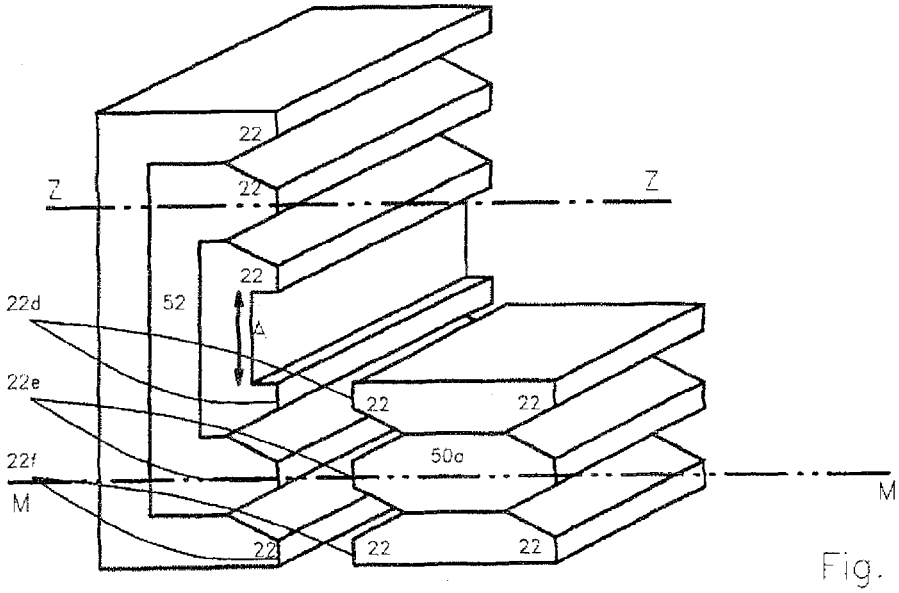
FIG. 3 illustrates, diagrammatically and in a plan view in perspective, one form of embodiment of a stator belonging to the gas exchange valve actuator according to the invention.

For the sake of clearer illustration, the stator 18 with its inner regions 50, 50*a* and outer regions 52, 52' is shown in detached form in FIG. 3. In this figure, one of the outer regions 52' and the upper inner region 50 have been omitted. What is not illustrated in the drawing, although it lies within the sphere of the invention, is that the outer regions 52, 52' of the stator 18 have at least one stator coil in addition to, or instead of, the inner regions 52 of said stator 18. As can be seen, the size of the coil arrangement 60, 60*a* in the direction of movement of the rotor 16 is larger than the distance between two adjacent pairs of teeth on the stator 18.

Figure 5:
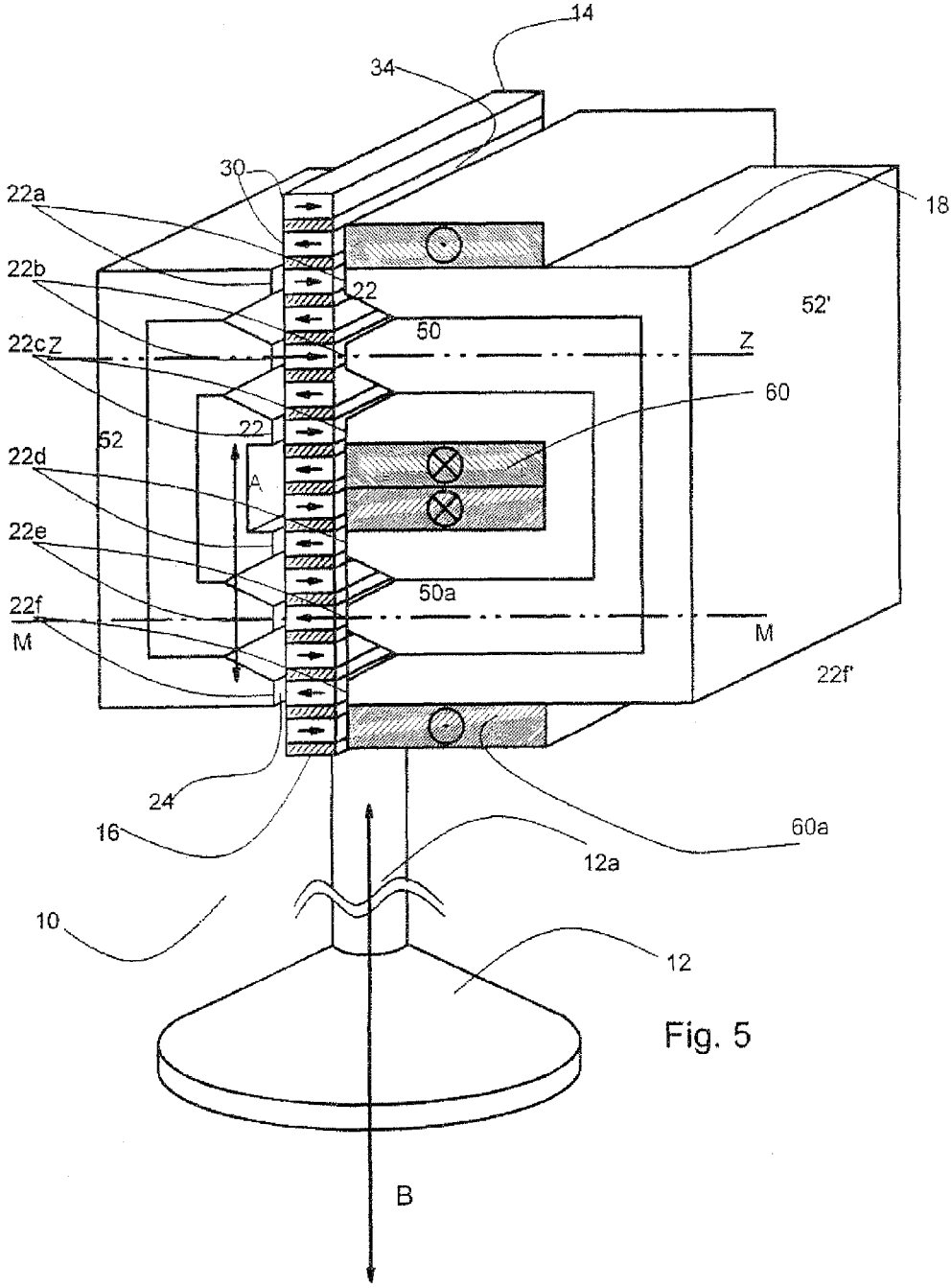
FIG. 5 illustrates, diagrammatically and in a longitudinal section in perspective, one form of embodiment of a gas exchange valve actuator according to the invention.

FIG. 5 illustrates a second form of embodiment of an electric linear motor 10. In this case, reference symbols used in the previous figures denote parts or components having the same or a comparable function or mode of operation and are therefore explained again below only in so far as their actual configuration, function or mode of operation differs from what has been described above.

In this form of embodiment, the rotor 16 has a stack 14 consisting of a large number of superposed permanently magnetic bars 30 having an essentially parallelepipedal design. The stator 18 is in the form of a soft-magnetic stack of bundles of metal plates. Said stator 18 has a number of pairs of teeth 22*a* . . . 22*f* with mutually opposed teeth 22. The stack 14 is received between the teeth 22 belonging to a pair of teeth, while forming an air gap 24 or 241 respectively.

On one side of the stack 14 on the rotor 16 (the right-hand side in FIG. 5), the stator 18 has two magnetically conductive inner regions 50, 50*a* which are arranged at a predetermined distance A from one another in the direction of movement B of the rotor 16. Each of the two inner regions 50, 50*a* of the stator 18 is surrounded, in each case, by an essentially hollow-cylindrical coil arrangement 60, 60*a*. In practice, these two inner regions 50, 50*a* of the stator 18 form the legs of a reclining "U", the connecting yoke of which is formed by a magnetically conductive outer region 52'. In other words, the second stack on the rotor is omitted in this form of embodiment, and the stator iron is shaped in a continuous manner. The externally located region 52 of the stator 18, which region lies outside the rotor 16, is of essentially comb-shaped design in cross-section and has, at its end that faces towards the stacks 14 on the rotor 16, teeth 22 which correspond in a mirror-inverted manner in their shape to the teeth of the internally located regions 50, 50' of the stator 18.

In this form of embodiment too, there is located, between the magnetically conductive inner regions 50, 50*a*, a predetermined distance A which is so dimensioned that it is essentially identical to the size of an even number (two in the form of embodiment shown) of permanently magnetic bars 30, 30' in the two stacks 14, 14' (with appertaining spacers) in the direction of movement B of the rotor 16. The length of the externally located regions 52, 52' of the stator 18, which are of comb-shaped design in cross-section, is likewise so dimensioned that corresponding teeth 22 at both ends, which teeth face towards the magnetic bars on the rotor 16, lie opposite a magnetic bar of different orientation in each case.

The forms of embodiment which have been explained are particularly suitable for achieving the required stroke of about 10-100 mm with the necessary dynamics in a relatively narrow installation space.

Linear actuators which are to be operated in a single-phase manner are described above. However, an arrangement of the linear actuator having two or more phases can also be designed within the sphere of the present invention. For this purpose, the teeth of another stator system with appertaining coils are to be positioned so as to be offset geometrically along the magnet of the rotor in a manner corresponding to the planned phase offset or offsets of the electrical driving power.

It is obvious to a person skilled in the art that individual aspects or features of the different forms of embodiment described above can also be combined with one another.

In the following claims reference numbers appear only for heuristic purposes and do not limit the scope of the claims to the referenced elements in the specification.

The invention claimed is:

1. Gas exchange valve actuator for a valve-controlled internal combustion engine, said actuator, comprising:

a rotor (16), which is to be coupled to a valve member (12), and a stator (18), wherein the rotor (16) has at least one stack (14, 14') of superposed permanently magnetic bars (30, 30'), and the stator (18) is formed, at least partially, from a soft-magnetic material and has at least one pair of teeth (22*a*, 22*a'*; 22*b*, 22*b'*; 22*c*, 22*c'*; 22*d*, 22*d'*; 22*e*, 22*e'*; 22*f*, 22*f'*) with mutually opposed teeth (22), of which each pair of teeth receives a stack (14, 14') between them while forming an air gap (24, 24') in each case, and wherein the stator (18) has at least two magnetically conductive inner regions (50, 50*a*) which are arranged at a predetermined distance A from one another in the direction of movement B of the rotor (16) and are at least partially surrounded, in each case, by a hollow-cylindrical coil arrangement (60, 60*a*), the central longitudinal axis M of which is oriented approximately transversely to the direction of movement B of the rotor (16).

2. Gas exchange valve actuator for a valve-controlled internal combustion engine according to claim 1, wherein the rotor (16) has two or more stacks (14, 14'), which are arranged at a predetermined distance from one another, of permanently magnetic bars (30, 30'), and the magnetically conductive inner regions (50, 50*a*) of the stator (18) are arranged between the stacks (14, 14') on the rotor (16).

3. Gas exchange valve actuator for a valve-controlled internal combustion engine according to claim 1, wherein the hollow-cylindrical coil arrangement (60, 60*a*) has a rectangular cross-section.

4. Gas exchange valve actuator for a valve-controlled internal combustion engine according to claim 1, wherein each tooth (22) has, in the direction of movement B of the rotor (16), a size which is essentially identical to the size of a permanently magnetic bar (30, 30') in the direction of movement B of the rotor (16), so that, when said rotor (16) is in a predetermined position, at least one pair of teeth on the stator (18) is in alignment with a permanently magnetic bar (30, 30').

5. Gas exchange valve actuator for a valve-controlled internal combustion engine according to claim 4, wherein pairs of teeth on the stator (18) which are adjacent in the direction of movement B of the rotor (16) are preferably so dimensioned, relative to the size of the permanently magnetic bars (30, 30') in the direction of movement B of the rotor (16), that at least one other of the permanently magnetic bars (30, 30') is arranged between two permanently magnetic bars (30, 30') which are in alignment with two mutually adjacent pairs of teeth on the stator (18).

6. Gas exchange valve actuator for a valve-controlled internal combustion engine according to claim 1, wherein the magnetically conductive inner regions (50, 50*a*) have at least one of the teeth (22) at their ends that face towards the rotor (16).

7. Gas exchange valve actuator for a valve-controlled internal combustion engine according to claim 1, wherein the stator (18) has at least one magnetically conductive outer region (52) which is located outside the stack (14, 14') on the rotor (16) and has at least one of the teeth (22) at its end that faces towards the stack (14, 14') on the rotor (16).

8. Gas exchange valve actuator for a valve-controlled internal combustion engine according to claim 1, wherein an externally located region (52, 52') of the stator (18) is of comb-shaped design in cross-section, at least in a partial section.

9. Gas exchange valve actuator for a valve-controlled internal combustion engine according to claim 2, wherein adjacent bars (30, 30') in a stack have an alternating magnetic orientation which is in alignment with the central longitudinal axis Z of two mutually opposed teeth (22) belonging to a pair of teeth.

10. Gas exchange valve actuator for a valve-controlled internal combustion engine according to claim 1, wherein the central longitudinal axis M of the coil arrangement (60) is oriented transversely to the direction of movement of the rotor (16) or is in alignment with the central longitudinal axis of two mutually opposed teeth belonging to a pair of teeth or is oriented parallel to said axis, at least in certain sections.

11. Gas exchange valve actuator for a valve-controlled internal combustion engine according to claim 1, wherein the predetermined distance A between the magnetically conductive inner regions (50, 50*a*) is so dimensioned that it is identical to the size of an even number of permanently magnetic bars (30, 30') in the two stacks (14, 14') in the direction of movement B of the rotor (16).

12. Gas exchange valve actuator for a valve-controlled internal combustion engine according to claim 2, wherein two adjacent permanently magnetic bars (30, 30') in each case in the two stacks (14, 14') on the rotor (16) are connected to one another at a predetermined distance by magnetically inactive spacers (34, 34').

13. Gas exchange valve actuator for a valve-controlled internal combustion engine according to one claim 2, wherein a pole pitch which is smaller than the size of the stator coil in the direction of movement B of the rotor (16) is defined by the dimensions of the permanently magnetic bars (30) in the direction of movement B of said rotor (16), and by the teeth (22) on the stator (18).

14. Gas exchange valve actuator for a valve-controlled internal combustion engine according to claim 1, wherein the outer regions (52) of the stator (18) have at least one stator coil in addition to, or instead of, the inner regions (52) of the stator (18).

15. Gas exchange valve actuator for a valve-controlled internal combustion engine according to claim 1, wherein the size of the coil arrangement (60, 60*a*) in the direction of movement of the rotor (16) is larger than the distance between two adjacent pairs of teeth on the stator (18).

16. Gas exchange valve actuator for a valve-controlled internal combustion engine according to claim 1, wherein the stator (18) is, at least partially, a soft-magnetic shaped body, preferably made of pressed and/or sintered metal powder.

17. Gas exchange valve actuator for a valve-controlled internal combustion engine according to claim 1, wherein the outer regions (52) of the stator form, at least partially, a magnetic short-circuiting body.

18. Valve-controlled internal combustion engine having at least one combustion cylinder, wherein at least one gas exchange valve actuator comprises:

a rotor (16), which is to be coupled to a valve member (12), and a stator (18), wherein the rotor (16) has at least one stack (14, 14') of superposed permanently magnetic bars (30, 30'), and the stator (18) is formed, at least partially, from a soft-magnetic material and has at least one pair of teeth (22*a*, 22*a'*; 22*b*, 22*b'*; 22*c*, 22*c'*; 22*d*, 22*d'*; 22*e*, 22*e'*; 22*f*, 22*f'*) with mutually opposed teeth (22), of which each pair of teeth receives a stack (14, 14') between them while forming an air gap (24, 24') in each case, and wherein the stator (18) has at least two magnetically conductive inner regions (50, 50*a*) which are arranged at a predetermined distance A from one another in the direction of movement B of the rotor (16) and are at least partially surrounded, in each case, by a hollow-cylindrical coil arrangement (60, 60*a*), the central longitudinal axis M of which is oriented approximately transversely to the direction of movement B of the rotor (16).

* * * * *